US009286870B2

(12) United States Patent
Hashimoto

(10) Patent No.: US 9,286,870 B2
(45) Date of Patent: Mar. 15, 2016

(54) PEDAL DEVICE FOR ELECTRONIC PERCUSSION INSTRUMENT

(75) Inventor: Ryuji Hashimoto, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 192 days.

(21) Appl. No.: 13/396,901

(22) Filed: Feb. 15, 2012

(65) Prior Publication Data

US 2012/0222542 A1 Sep. 6, 2012

(30) Foreign Application Priority Data

Mar. 2, 2011 (JP) ..... 2011-044867

(51) Int. Cl.
*G10D 13/02* (2006.01)
*G10H 1/34* (2006.01)

(52) U.S. Cl.
CPC ..... *G10H 1/348* (2013.01); *G10H 2230/275* (2013.01)

(58) Field of Classification Search
USPC ..... 84/746
See application file for complete search history.

(56) References Cited

U.S. PATENT DOCUMENTS 4,111,407 A * 9/1978 Stager ..... 267/166.1
4,744,279 A * 5/1988 Livingston ..... 84/746
5,166,466 A 11/1992 Yamauchi
6,979,770 B2 * 12/2005 Hampton, Jr. ..... 84/723
7,470,847 B2 * 12/2008 Kitagawa ..... 84/422.1
8,344,235 B2 * 1/2013 Steele ..... G10H 1/348 84/422.3
8,785,758 B2 * 7/2014 Wissmuller ..... G10H 1/348 84/422.3
2006/0096448 A1 * 5/2006 Yoshino ..... G10H 1/34 84/734
2008/0098873 A1 5/2008 Kitagawa
2009/0106908 A1 * 4/2009 DeFranks ..... A47C 23/0438 5/716
2010/0018378 A1 * 1/2010 Takigawa ..... 84/171
2011/0148018 A1 * 6/2011 Defranks ..... A47C 23/0438 267/166.1

FOREIGN PATENT DOCUMENTS

JP 0432897 A 2/1992
JP 06346625 A 12/1994
JP 0997075 A 4/1997
JP 2008-145464 A 6/2008

OTHER PUBLICATIONS

Optimum Spring Solutions, Inc., "Compression Spring Manufacturer," Mar. 3, 2010, p. 1.*
Optimum Spring Solutions, Inc. "Compression Spring Manufacturer." Mar. 3, 2010. p. 1 [online].*
Office Action issued in JP2011-044867, mailed Feb. 24, 2015. English translation provided.

* cited by examiner

*Primary Examiner* — Christopher Uhlir
(74) *Attorney, Agent, or Firm* — Rossi, Kimms & McDowell, LLP

(57) ABSTRACT

A pedal device for an electronic percussion instrument, including: a base; a foot board pivotable in a pivotable range between lower and upper limit positions; and an elastically holding mechanism for holding the foot board such that the foot board keeps an equilibrium state at an initial position within the pivotable range, the foot board being configured such that (a) when the foot board is located between the initial and the upper limit positions, it is given by the mechanism a return force having a linear characteristic with respect to a change of its pivot angle, the return force being for permitting the foot board to return to the initial position, and (b) when the foot board is located between the initial and the lower limit positions or between: an intermediate position and the lower limit position, the foot board is given the return force having a nonlinear characteristic.

15 Claims, 4 Drawing Sheets

PEDAL DEVICE FOR ELECTRONIC PERCUSSION INSTRUMENT

CROSS REFERENCE TO RELATED APPLICATION

The present application claims priority from Japanese Patent Application No. 2011-044867, which was filed on Mar. 2, 2011, the disclosure of which is herein incorporated by reference in its entirety.

BACKGROUND OF THE INVENTION

1. Field of the Invention

The present invention relates to a pedal device for an electronic percussion instrument.

2. Discussion of Related Art

A pedal device for an electronic percussion instrument is known. In the pedal device described in the following Patent Literature 1, a foot board is pivotably supported on a base plate (a base), and a weight is provided at a free end of the foot board. Further, a tension coil spring is provided at the free end of the foot board. The known pedal device aims at achieving a depression feeling close to that in an acoustic drum owing to an inertial force by the weight and a load increase by the tension coil spring at a time when the foot board is depressed or stepped on.

Patent Literature 1: JP-A-2008-145464

SUMMARY OF THE INVENTION

The pedal device described in the above Patent Literature 1 is placed in an equilibrium state at a position where the length of the tension coil spring is the smallest, in a non-operated state in which the foot board is not operated. The foot board has a pivotable range in which the foot board is pivotable from an initial position at which the foot board is in the equilibrium state, in both of a depression direction of the foot board and a direction opposite to the depression direction (hereinafter referred to as a "counter-depression direction" where appropriate).

When the foot board pivots in the depression direction by a depression operation by a player or performer, the tension coil spring expands or extends, so that a return force that allows the foot board to return to the initial position is the largest when the foot board is located at a lower limit position in the pivotable range. Accordingly, the arrangement advantageously attains a quick return of the foot board when the player releases his/her foot from the foot board which is in a depression state, namely, when the foot board returns to the initial position from the depression state.

However, the foot board temporarily pivots, owing to the inertia, further in the counter-depression direction after having passed the initial position. The tension coil spring is expanded also when the foot board is located at a position which is away from the initial position in the counter-depression direction. Accordingly, there acts, on the foot board, a force in a direction toward the initial position, (here, in a pivotal direction which is the same as the depression direction). Since a change of the expansion amount of the tension coil spring is larger than a change of the pivot angle of the foot board, however, the spring constant of the tension coil spring that actually acts on the foot board is large, so that the force becomes nonlinear.

As a result, in spite of the fact that the foot of the player is already raised upward by a release operation in which the foot is released from the foot board that is in the depression state, only the foot board quickly moves in the depression direction and returns to the initial position, causing a situation in which the foot board is moved downward prior to timing of a next or subsequent depression operation. In such a situation, the player feels as if he/she fails to depress the foot board, so that the operation feeling of the foot board considerably differs from that of an acoustic drum.

Thus, in a performance operation in which the depression operation and the release operation of the foot board are alternated successively, there has been a problem that the foot board does not follow the movement of the foot of the player especially in the depression operation which is conducted immediately after the release operation, and accordingly the player therefore feels an uncomfortable or unnatural feeling.

The present invention has been made to solve the conventionally experienced problem. It is therefore an object of the invention to provide a pedal device for an electronic percussion instrument in which a foot board is capable of following a movement of a foot of a player to an enhanced degree.

To attain the object indicated above, the present invention provides a pedal device for an electronic percussion instrument, comprising:

a base (10) placed on a floor surface (24);

a foot board (20) pivotably supported at one end portion (20*a*) thereof with respect to the base and configured to pivot in a pivotable range between a lower limit position in a depression direction and an upper limit position in a direction opposite to the depression direction; and an elastically holding mechanism (16, 20; 20, 31, 32; 16, 20, 33; 20, 35) configured to elastically hold the foot board such that the foot board keeps an equilibrium state at an initial position within the pivotable range in a non-operated state in which the foot board is not operated, wherein the foot board is configured such that (a) when the foot board is located between the initial position and the upper limit position, the foot board is given by the elastically holding mechanism a return force having a linear characteristic with respect to a change of a pivot angle of the foot board, the return force being for permitting the foot board to return to the initial position, and (b) when the foot board is located between the initial position and the lower limit position or when the foot board is located between: an intermediate position between the initial position and the lower limit position; and the lower limit position, the foot board is given by the elastically holding mechanism the return force having a nonlinear characteristic with respect to the change of the pivot angle of the foot board.

The reference numerals in the brackets attached to respective constituent elements of the device in the above description correspond to reference numerals used in the following embodiments to identify the respective constituent elements. The reference numerals attached to each constituent element indicates a correspondence between each element and its one example, and each element is not limited to the one example.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be explained one embodiment of the present invention with reference to the drawings.

Figure 1:
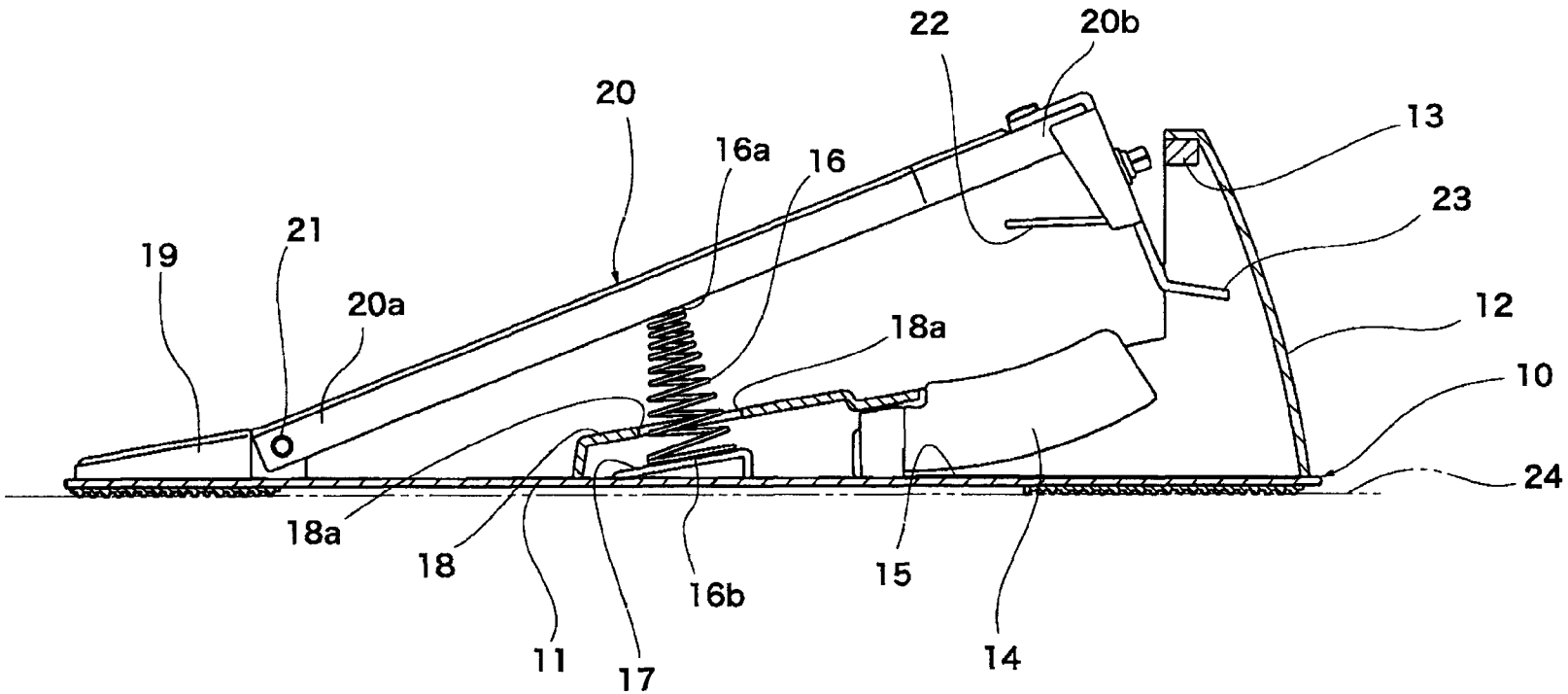
FIG. 1 is a schematic side view of a pedal device for an electronic percussion instrument according to one embodiment of the present invention.
Figure 2A:
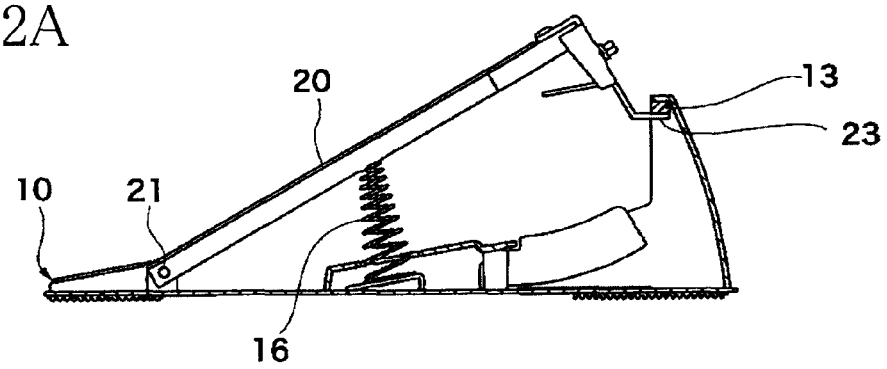
FIGS. 2A-2D are views for explaining a transition of a state of a foot board when the foot board pivots from an upper limit position to a lower limit position.
Figure 2B:
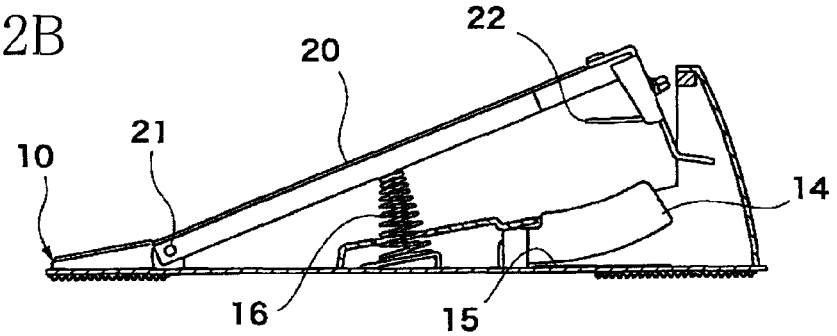
Figure 2C:
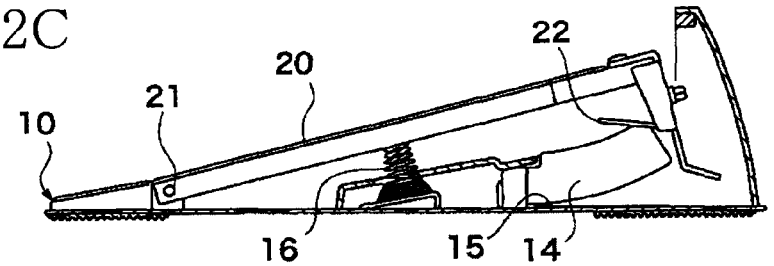
Figure 2D:
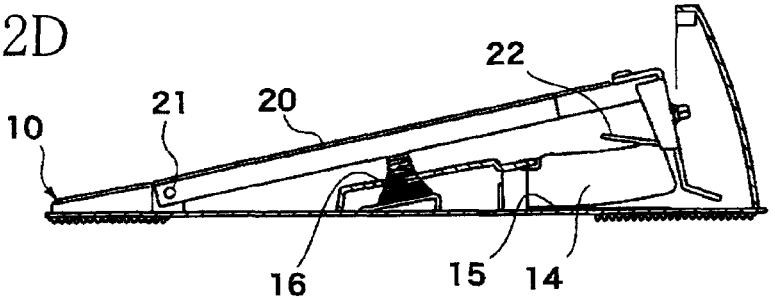

Referring first to the schematic side view of FIG. 1, a pedal device for an electronic percussion instrument constructed according to the embodiment of the present invention will be explained. The pedal device is constituted as a kick pedal used in an electronic bass drum as the electronic percussion instrument. The pedal device is disposed on a floor surface 24 and is operated for performance by depressing or stepping on a foot board 20. FIG. 1 shows a non-operated state of the foot board 20 and a free state of the foot board 20 in which the foot board 20 is pivotable. FIG. 1 further shows a state in which a downward force by the gravity of the foot board 20 and an upward force by a coil spring 16 are balanced, namely, an equilibrium state of the pedal device. Hereinafter, a front-rear direction and an up-down direction of the pedal device are used with reference to a state in which the pedal device is placed on the horizontal floor surface 24, and the left side in FIG. 1 corresponds to the front side of the pedal device while the upper side in FIG. 1 corresponds to the upper side of the pedal device.

As shown in FIG. 1, the pedal device includes a base plate 10, and the foot board 20 having a plate-like shape is disposed on the base plate 10. The base plate 10 has: a base portion 11 which is parallel to the horizontal floor surface 24; and a cover 12 extending upward from the base portion 11. A stopper portion 13 formed of a buffer member is disposed on an underside of a ceiling part of a rear portion of the cover 12.

A heel 19 is provided at a front part of the base portion 11 of the base plate 10, and a shaft 21 is provided at the heel 19 so as to extend in the left-right direction of the pedal device, namely, in the depth direction in FIG. 1. The foot board 20 is pivotably supported at a front end portion 20*a* thereof by the shaft 21, whereby the foot board 20 is configured such that its rear end portion 20*b* as a free end portion is pivotable about the shaft 21 in the up ward direction and the downward direction, namely, in the clockwise direction and the counter-clockwise direction in FIG. 1. In this respect, the shaft 21 will be hereinafter referred to as a "pivot shaft 21" where appropriate. The direction of the pivotal movement (the pivotal direction) of the foot board 20 will be described as follows. The direction in which the rear end portion 20*b* pivots clockwise is referred to as a "depression direction". The direction in which the rear end portion 20*b* pivots counterclockwise, namely, the direction opposite to the depression direction, is referred to as a "counter-depression direction". At a lower part of the rear end portion 20*b* of the foot board 20, a press plate 22 is provided so as to extend frontward and a limit plate 23 is provided so as to extend rearward.

A spring support portion 17 is fixedly provided at an intermediate part of the base portion 11 in the front-rear direction of the pedal device. Further, a spring cover portion 18 is provided so as to cover the spring support portion 17. The spring support portion 17 and the spring cover portion 18 are formed as a part of the cover 12. A coil spring 16 is disposed at the spring support portion 17 so as to pass through a hole 18*a* formed in the spring cover portion 18. The coil spring 16 is fixed at a lower end 16*b* thereof to the spring support portion 17 and at an upper end 16*a* thereof to the lower surface of the foot board 20.

In the non-operated state of the foot board 20 in which the foot is not placed thereon and the free state of the foot board 20 in which the foot board is pivotable, the foot board 20 slightly compresses the coil spring 16 owing to its self weight, and accordingly the pedal device is kept in the equilibrium state shown in FIG. 1. As explained later, the foot board 20 is pivotable within a range defined by and between an upper limit position in the counter-depression direction and a lower limit position in the depression direction (i.e., a depression end position). An initial position is defined as a position within the pivotable range. In other words, the initial position of the foot board 20 is a position in the pivotable range except for the upper limit position and the lower limit position. In some instances such as an instance in which the pedal device is held by a hand upside down or invertedly, the foot board 20 largely pivots in the counter-depression direction beyond the initial position. In this case, the limit plate 23 comes into contact with the stopper portion 13, thereby defining the upper limit position in the counter-depression direction.

FIGS. 2A-2D show a transition in the pivotal movement of the foot board 20. FIGS. 2A-2D show the foot board 20 located at the upper limit position in the counter-depression direction, at the initial position, at an intermediate position between the initial position and the lower limit position in the depression direction, and at the lower limit position in the depression direction, respectively.

As shown in FIG. 1, there are provided, on the upper surface of the base portion 11, an actuator 14 and a sensor 15 which is constituted by a sensor pattern. The actuator 14 is formed of an elastic member such as rubber. The front end portion of the actuator 14 is fixed to the base portion 11 and the rear end portion of the actuator 14 is curved upward, so as to have an arcuate shape. When the free end (the rear end portion) of the actuator 14 is pressed by the press plate 22 as a result of depression of the foot board 20, the actuator 14 deforms such that a radius of curvature of the arc becomes large. The position of the foot board 20 at a time when the actuator 14 is pressed so as to be generally horizontal corresponds to a pivot end position of the foot board 20 in a forward direction, namely, the above-indicated lower limit position in the depression direction shown in FIG. 2D.

When the actuator 14 comes into contact with the sensor 15, the sensor 15 outputs a detection signal in accordance with the contact state. The contact area increases with an increase in a degree of deformation of the actuator 14. In other words, the contact area increases with an increase in the pivot angle of the foot board 20 in the depression direction with respect to the base portion 11. The sensor 15 is configured to have an electric resistance value which becomes smaller as the contact area with respect to the actuator 14 becomes large. By obtaining a change in the resistance value, the position of the foot board 20 and the degree of depression of the foot board 20 are detected, whereby a volume, a tone, etc. of a sound to be generated can be changed in accordance with the detected position and depression degree of the foot board 20. Here, the "pivot angle" refers to an angle of a position of the foot board 20 after it has pivoted about the pivot shaft 21 from the initial position, with respect to the initial position. In this respect, the pivot angle may be referred to as a pivot amount of the foot board 20 from the initial position.

The detection signal is outputted through a jack (not shown). The outputted signal is sent to a signal processing portion (not shown) as a percussion performance trigger signal and is converted into percussion performance data or into a sound in real time. The structure of the sensor 15 is not limited, provided that the sensor 15 is configured to detect the position and the depression degree of the foot board 20 on the basis of the pressing force from the actuator 14. For instance, the sensor 15 may be a piezoelectric sensor.

There will be next explained a structure of the coil spring 16 and a return force exerted on the foot board 20 in accordance with expansion and contraction of the coil spring 16. In the coil spring 16, its coil portion has an outside diameter which increases, in the vertical direction, from one end (lower end 16*b*) near to the base portion 11 toward another end (upper end 16*a*) remote from the base portion 11. Thus, the coil spring 16 has a generally conical shape in side view. Further, the coil spring 16 has a constant coil thickness. The coil spring 16 is configured to generate a force against the gravity that acts on the foot board 20 and apply the force from the underside of the foot board 20, thereby elastically holding the foot board 20 such that the pedal device is kept in the equilibrium state when the foot board is located at the initial position. Accordingly, when the foot board 20 is moved away from the initial position in the counter-depression direction and the coil spring 16 is accordingly expanded to a larger degree than when the foot board 20 is located at the initial position, namely, the coil spring 16 is in an expansion state, a force in the depression direction is exerted on the foot board 20 as the return force by which the foot board 20 is returned to the initial position. On the other hand, when the foot board 20 is moved away from the initial position in the depression direction and the coil spring 16 is accordingly contracted to a larger degree than when the foot board 20 is located at the initial position, namely, the coil spring is in a compression state, a force in the counter-depression direction is exerted on the foot board 20 as the return force.

In the present embodiment, the actuator 14 also generates the return force with respect to the foot board 20. However, the force generated by the actuator 14 is considerably smaller than the force generated by the coil spring 16. Accordingly, the force generated by the actuator 14 is ignorable. Further, in the present embodiment, the coil spring 16 is disposed such that the expansion amount and the compression amount of the coil spring 16 are substantially proportional to a change of the pivot angle of the foot board 20.

Figure 3A:
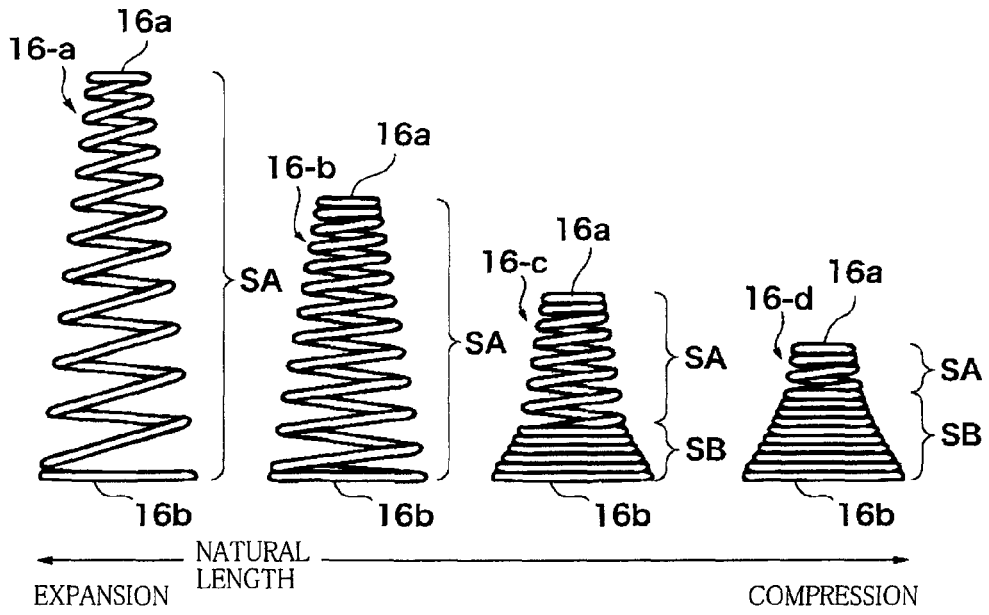
FIG. 3A is a view for explaining a transition of a state of expansion and contraction of a coil spring and FIG. 3B is a graph showing a relationship between depression angle of the foot board and load (return force) which is exerted on the foot board.
Figure 3B:
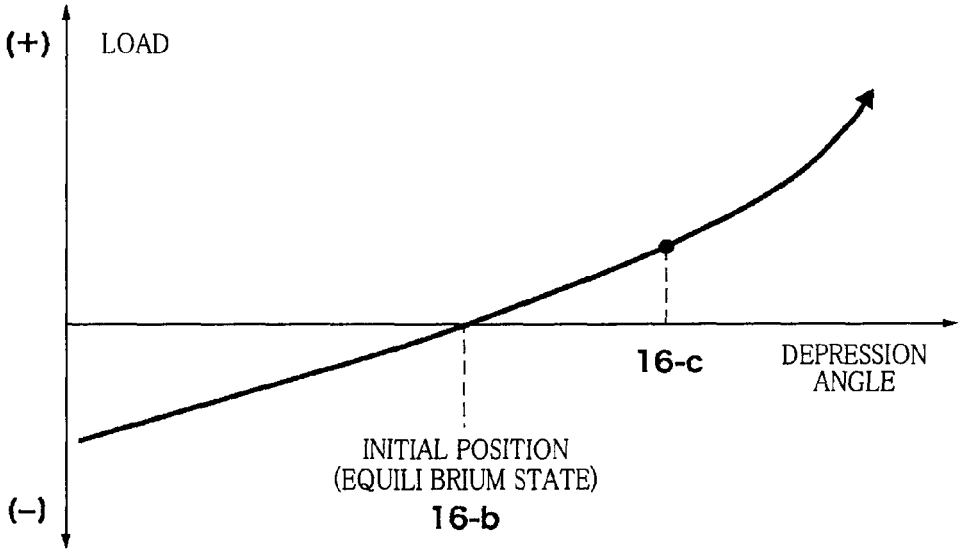

FIG. 3A shows a transition a state of expansion and contraction of the coil spring 16. The coil spring 16-*a*, 16-*b*, 16-*c*, and 16-*d* in FIG. 3A corresponds to the coil spring 16 in FIGS. 2A-2D, respectively. FIG. 3B is a graph showing a relationship between depression angle of the foot board 20 (pivot angle where the forward direction that is the depression direction is represented as positive (+)) and load applied to the foot board 20 (return force by which the foot board 20 is returned to the initial position). In the graph of FIG. 3B, the horizontal axis represents the depression angle of the foot board 20. In FIG. 3B, the pivot angle on the right side of a position on the horizontal axis that corresponds to the initial position represents the pivot angle when the foot board 20 is located away from the initial position so as to be closer to the lower limit position in the depression direction. On the other hand, the pivot angle on the left side of the position on the horizontal axis that corresponds to the initial position represents the pivot angle when the foot board 20 is located away from the initial position so as to be closer to the upper limit position in the counter-depression direction. Further, in FIG. 3B, the return force in a reverse direction which is opposite to the forward direction and which is the counter-depression direction is represented as "+" while the return force in the forward direction corresponding to the depression direction is represented as "−". It is noted that the length of the coil spring 16 becomes equal to a natural length during transition from the coil spring 16-*a* to the coil spring 16-*b* shown in FIG. 3A.

As shown in FIG. 3B, in the equilibrium state (in which the foot board 20 is located at the initial position), the return force toward the initial position which is exerted on the foot board 20 being held by the coil spring 16 is equal to 0. At an initial period in which the foot board 20 is depressed from the initial position, the effective range (effective length) SA of the coil spring 16 which is a range effective as a spring is equal to the entire length of the coil spring 16 (corresponding to 16-*b* shown in FIG. 2B and FIG. 3A). As the foot board 20 is further depressed, the return force in the reverse direction generated by the coil spring 16 gradually increases. In this instance, since the coil spring 16 is conical, the coil spring 16 begins to contract first from a section thereof nearer to the lower end 16*b* and having a larger outside diameter. Thereafter, there is generated, at the section nearer to the lower end 16*b*, an ineffective range SB in which the coil spring 16 contracts to a maximum extent and cannot be compressed any more. As a result, the effective range SA becomes smaller (as indicated by 16-*c* shown in FIG. 2C and FIG. 3A.

When the effective range SA becomes smaller, the coil spring 16 acts as a spring whose outside diameter is small. Accordingly, the spring constant of the coil spring 16 that actually acts on the foot board 20 becomes larger than that when the pedal device is in the equilibrium state. When the foot board 20 is further depressed, the effective range SA becomes much smaller. Accordingly, the spring constant of the coil spring 16 gradually increases, and the coil spring 16 becomes the state indicated by 16-*d* shown in FIG. 2D and FIG. 3A when the foot board 20 is located at the lower limit position. Therefore, in the midst of the depression stroke, the degree of increase in the return force with respect to the change of the depression angle gradually becomes higher. Accordingly, at the moment when the foot is abruptly released from the foot board 20 which is in the depression state, a large magnitude of the return force is applied to the foot board 20, thereby ensuring a quick return of the foot board 20 and good following property to the foot. In this respect, the pivot angle of the foot board 20 at a time when the degree of increase in the return force begins to gradually become higher corresponds to the pivot angle at a time when the ineffective range SB in which the coil spring 16 cannot be compressed begins to generate in the section of the coil spring 16.

On the other hand, when the foot is moved upwardly of the initial position immediately after the foot board 20 has been released from being depressed, the foot board 20 is moved toward the initial position by the return force for permitting the foot board 20 to be returned to the initial position and thereafter the foot board 20 pivots, owing to the inertia, in the counter-depression direction beyond the initial position. On this occasion, the coil spring 16 expands, and the return force in the forward direction for permitting the foot board 20 to be returned to the initial position gradually increases. In general, the foot board 20 begins to return to the initial position without reaching the upper limit position (at which the state of the coil spring 16 is indicated by 16-*a* shown in FIG. 2A and FIG. 3A). Should the foot board 20 reaches the upper limit position at which the stopper portion 13 and the limit plate 23 are brought into abutting contact with each other, a force that additionally applied to the foot board 20 is merely a reaction force by the abutment of the stopper portion 13 and the limit plate 23, as compared with an instance in which the stopper portion 13 and the limit plate 23 are not held in abutting contact. In the instance in which the stopper portion 13 and the limit plate 23 are not held in abutting contact, the foot board 20 pivots in the forward direction by the force owing to its self weight and the force from the coil spring 16.

Here, in a state in which the effective range SA is equal to the entire length of the coil spring 16, the force generated by the coil spring 16 in accordance with the expansion amount or the compression amount has a linear characteristic. In a pivot area of the foot board 20 from the initial position to the upper limit position, the coil spring 16 applies, to the foot board 20, a force having the linear characteristic in the direction toward the initial position. Accordingly, in the pivot area of the foot board 20 from the initial position to the upper limit position, the foot board 20 receives a constant force owing to its self weight, in addition to the force having the linear characteristic in accordance with the expansion amount generated by the coil spring 16. In other words, when the foot board 20 is located between the initial position and the upper limit position, the foot board 20 receives the return force having the linear characteristic with respect to the change of the pivot angle of the foot board 20 from the position of the foot board 20 at which the coil spring 16 has the natural length. On the other hand, in a pivot area of the foot board 20 from the initial position to the lower limit position, the coil spring 16 gives the foot board 20 a force having a linear characteristic in accordance with the compression amount in the direction toward the initial position, in an area from the initial position to an intermediate position between the initial position and the lower limit position, namely, until the ineffective range SB is generated, while the coil spring 16 gives the foot board 20 a force having a nonlinear characteristic (which is not linear) in accordance with the compression amount toward the initial position in an area from the intermediate position to the lower limit position. Accordingly, in the area of the pivotal movement of the foot board 20 from the initial position to the intermediate position, the foot board 20 receives the constant force owing to its self weight, in addition to the force having the linear characteristic in accordance with the compression amount generated by the coil spring 16. Further, in the area of the pivotal movement of the foot board 20 from the intermediate position to the lower limit position, the foot board 20 receives the constant force owing to its self weight, in addition to the force having the nonlinear characteristic in accordance with the compression amount generated by the coil spring 16. In other words, when the foot board 20 is located between the initial position and the intermediate position, the foot board 20 receives the return force having the linear characteristic with respect to the change of the pivot angle of the foot board 20 from the position of the foot board 20 at which the coil spring 16 has the natural length. When the foot board 20 is located between the intermediate position and the lower limit position, the foot board 20 receives the return force having the nonlinear characteristic with respect to the change of the pivot angle of the foot board 20 from the position of the foot board 20 at which the coil spring 16 has the natural length. Here, the linear characteristic may not be completely linear depending upon the disposition of the coil spring 16 such as an angle at which the coil spring 16 is disposed. In the present embodiment, however, the characteristic which is very close to the linear characteristic as compared with the nonlinear characteristic is referred to as the linear characteristic.

Thus, in the midst of the pivotal movement of the foot board 20 from the initial position to the lower limit position, namely, in the area between the intermediate position and the lower limit position, the spring constant of the coil spring 16 that actually acts on the foot board 20 becomes, large and the degree of the change of the return force with respect to the change of the pivot angle of the foot board 20 becomes large, thereby ensuring a quick return of the foot board 20 upon completion of the depression of the foot board 20. In addition, since the return force in the pivot area from the initial position to the upper limit position has the linear characteristic, the return force in the forward direction in the release operation in which the foot is released from the foot board 20 in the depression state is not excessively large and the return of the foot board 20 is not too quick. Accordingly, when the depression operation is subsequently conducted immediately after the release operation, there is unlikely to occur a situation in which the foot board 20 is moved downward prior to timing of the subsequent depression operation. Therefore, the player is prevented from feeling as if he/she fails to depress the foot board 20.

The present embodiment attains both of a quick return of the foot board 20 from the depression end poison and a not-too-quick return of the foot board 20 from a position higher than the initial position, making it possible to enhance the following property of the foot board 20 to the foot in both of the depression operation and the release operation. Accordingly in a performance operation in which the depression operation and the release operation of the foot board 20 are alternated successively, the foot board 20 follows the movement of the foot of the player especially in the depression operation which is conducted immediately after the release operation, thereby mitigating an uncomfortable or unnatural feeling as felt by the player. Further, the change of the spring characteristic of the coil spring 16 is attained by the single coil spring 16 having the conical shape, ensuring a simplified and downsized structure.

In the present embodiment, in the area from the intermediate position which is intermediate between the initial position and the lower limit position, to the lower limit position, the spring characteristic of the coil spring 16 has the nonlinear characteristic. The spring characteristic may be modified otherwise. For instance, the spring characteristic may have the nonlinear characteristic over the entire range from the initial position to the lower limit position.

The coil spring 16 needs to be interposed between the base portion 11 of the base plate 10 and the foot board 20 such that one and the other of opposite ends of the coil spring 16 are fixed to the base portion 11 and the foot board 20, respectively.

An elastically holding mechanism for holding the foot board 20 at the initial position is configured to give, to the foot board 20, the force owing to the self weight of the foot board 20 and the force in accordance with the expansion amount or the compression amount generated by the coil spring 16 so as to be superposed on each other. The elastically holding mechanism may be otherwise constructed by adding other structure to the coil spring 16. For instance, the actuator 14 may be configured to cooperate with the coil spring 16 to give the foot board 20 the force in the reverse direction, by selecting, as the material for the actuator 14, a material capable of positively generating a reaction force. In this instance, the actuator 14 is configured to have a high spring constant capable of exhibiting a definite elastic force. From a time point when the limit plate 23 begins to press the actuator 14 in the midst of the pivotal movement of the foot board 20 from the initial position to the lower limit position, the degree of increase of the force exerted on the foot board 20 becomes higher. Accordingly, the return force rapidly increases in the area of the pivotal movement of the foot board 20 in the forward direction from the intermediate position to the lower limit position. Therefore, it is possible to enhance a return speed of the foot board 20 immediately after the foot board 20 has been released from being depressed. Where the actuator 14 having a high spring constant is used, there may be used, as the coil spring, the coil spring 16 having the conical shape used in the present embodiment or there may be used other coil spring having a cylindrical shape. The coil spring having the cylindrical shape is configured to generate a force having a linear characteristic in accordance with an expansion amount or a compression amount thereof.

In the present embodiment, the coil spring 16 has the conical shape in which the outside diameter gradually changes in a direction from one of its opposite ends toward the other end. The coil spring 16 may be otherwise constructed. For instance, the coil spring may be cylindrical and may have different coil thickness values such that the coil thickness increases stepwise or linearly toward one end of the coil spring nearer to the base portion 11. Alternatively, one coil spring may be formed of a combination of different coils having mutually different spring constants by using different materials while the coil thickness is made constant.

Next, there will be explained examples of the elastically holding mechanism for giving the foot board 20 the return force having the nonlinear characteristic in the entire range from the initial position to the lower limit position or in the area from the intermediate position to the lower limit position. The examples will be explained as first through third modified embodiments with reference to FIGS. 4A-4C.

Figure 4A:
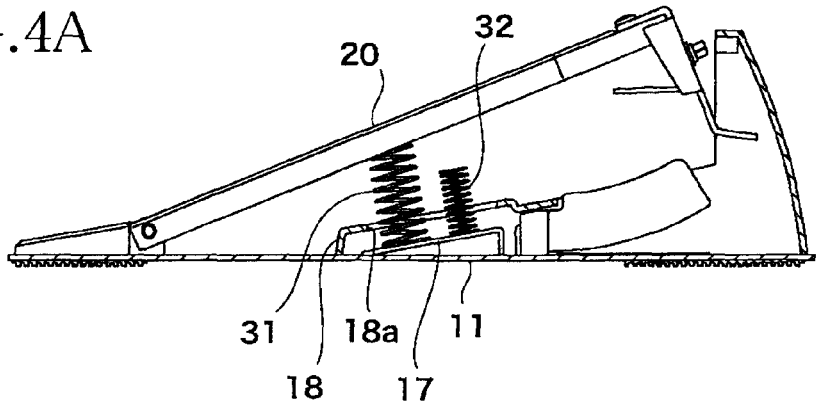
FIGS. 4A-4D are schematic side views showing pedal devices according to modified embodiments each as a modification of the pedal device according to the embodiment of the invention.
Figure 4B:
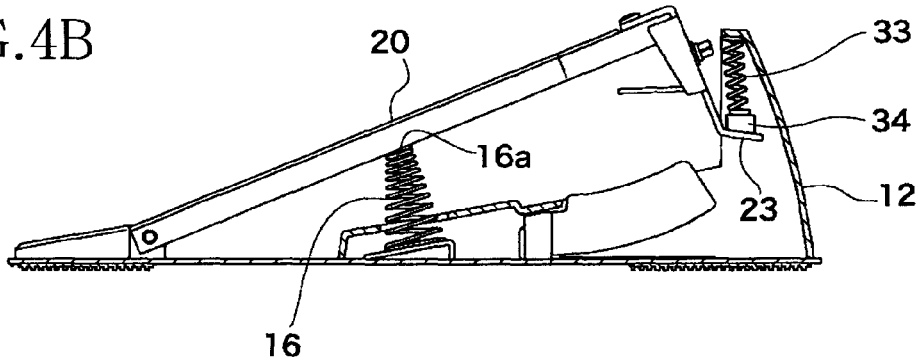
Figure 4C:
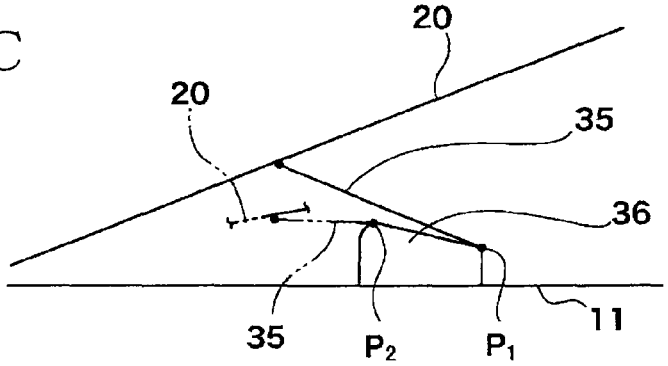

FIGS. 4A-4C are schematic side views of the pedal devices in which the elastically holding mechanisms respectively according to the first through third modified embodiments are employed.

In the first modified embodiment shown in FIG. 4A, two coil springs, i.e., a first coil spring 31 as a first elastic member and a second coil spring 32 as a second elastic member, are used in place of the coil spring 16 used in the illustrated embodiment. The coil springs 31, 32 are disposed at the spring support portion 17 so as to pass through the hole 18*a* formed in the spring cover portion 18. Each of the coil springs 31, 32 is not conical, but has a cylindrical shape and has a coil portion whose outside diameter is constant over the entire length. The first coil spring 31 is fixed to both of the lower surface of the foot board 20 and the spring support portion 17. The second coil spring 32 is fixed at its lower end to the spring support portion 17, and an upper end of the second coil spring 32 is not fixed to any member. The pedal device of FIG. 4A is similar in construction with the pedal device of FIG. 1 except the above.

In the thus constructed pedal device, when the foot board 20 is in the non-operated state and in the free state, the foot board 20 slightly compresses the first coil spring 31 by its self weight and the pedal device is kept in the equilibrium state shown in FIG. 4A. In the equilibrium state, there is a distance between the second coil spring 32 and the lower surface of the foot board 20. In the pivotal movement of the foot board 20 from the initial position to the lower limit position, the foot board 20 comes into contact with the second coil spring 32 and begins to compress the same 32 in the midst of the pivotal movement at an intermediate position which is intermediate between the initial position and the lower limit position. Accordingly, the degree of change of the return force with respect to the change of the pivot angle of the foot board 20 becomes higher from the intermediate position. In this sense, the return force with respect to the pivot angle of the foot board 20 has a nonlinear characteristic.

On the other hand, in the pivot area from the initial position to the upper limit position, the foot board 20 receives a force generated by the first coil spring 31 owing to expansion thereof and a force owing to the self weight of the foot board 20. Since the force generated by the first coil spring 31 has a linear characteristic with respect to the change of the pivot angle of the foot board 20, the return force has a linear characteristic.

In the first modified embodiment shown in FIG. 4A, the second coil spring 32 may be modified such that its upper end is fixed to the lower surface of the foot board 20 while its lower end is not fixed to any member, but is configured to come into contact with a stationary portion which is stationary with respect to the base portion 11 of the spring support portion 17 or the like, in the depression stroke of the foot board 20. In the first modified embodiment, a third or more coil springs with a lower height than the second coil spring 32 may be disposed. That is, by using three or more coil springs, the degree of change of the return force in the reverse direction may be made higher stepwise. In the first modified embodiment, in place of providing the second coil spring 32, the actuator 14 may be formed of a material capable of exhibiting a high spring constant as described above, whereby the actuator 14 may be configured to cooperate with the first coil spring 31 to give the foot board 20 the return force in the reverse direction. The first coil spring 31, the second coil spring 32, and the actuator 14 may not be limited to springs and elastic materials, provided that each of the first coil spring 31, the second coil spring 32, and the actuator 14 is an elastic member capable of exhibiting elasticity.

FIG. 4B shows a pedal device according to the second modified embodiment. The pedal device of FIG. 4B is constructed such that a coil spring 33 is additionally disposed in the pedal device of FIG. 1. The coil spring 33 is disposed between the underside of the ceiling part of the rear portion of the cover 12 and the limit plate 23. The coil spring 33 is fixed at its upper end to the underside of the ceiling part of the rear portion of the cover 12, so as to hang therefrom. A buffer member 34 functioning also as a stopper is fixed to the lower end of the coil spring 33. The buffer member 34 is not fixed to the limit plate 23. The coil portion of the coil spring 33 has an outside diameter which is constant over the entire length of the coil spring 33. In this second modified embodiment, the upper end 16*a* of the coil spring 16 is not fixed to the foot board 20.

In the thus constructed pedal device, when the foot board 20 is in the non-operated state and in the free state, the foot board 20 slightly compresses the coil spring 16 by its self weight, and the pedal device is kept in the equilibrium state shown in FIG. 4B. In the equilibrium state, the foot board 20 is in contact with the upper end 16*a* of the coil spring 16, and the limit plate 23 is in contact with the buffer member 34. In the pivot area from the initial position to the lower limit position, the limit plate 23 is located away from the buffer member 34 except for an area that is very close to the initial position. Accordingly, the coil spring 16 mainly gives a force to the foot board 20 while the coil spring 33 does not give a force to the foot board 20. In addition, as in the illustrated embodiment of FIG. 1, the coil spring 16 gives the foot board 20 a force having a nonlinear characteristic in the area of the pivotal movement in the depression direction between the intermediate position and the lower limit position.

On the other hand, in the pivot area from the initial position to the upper limit position, the foot board 20 is located away from the upper end 16*a* of the coil spring 16 except for an area that is very close to the initial position. Accordingly, the coil spring 33 gives a linear force to the foot board 20 while the coil spring 16 does not give a force to the foot board 20. When the coil spring 33 contracts to a maximum extent and cannot contract any more, the limit plate 23 abuts on the underside of the ceiling part of the rear portion of the cover 12 via the buffer member 34, whereby the upper limit position of the foot board 20 in the counter depression direction is defined.

Even in the above arrangement in which the mutually different springs are used in the area away from the initial position in the depression direction and in the area away from the initial position in the counter-depression direction for giving the force to the foot board 20, the characteristic of the return force with respect to the change of the pivot angle of the foot board 20 is similar to that in the illustrated embodiment of FIG. 1. In other words, in the area of the pivotal movement of the foot board 20 from the intermediate position between the initial position and the lower limit position, to the lower limit position, the characteristic of the return force exerted on the foot board 20 can be made nonlinear with respect of the change of the pivot angle of the foot board 20.

In this second modified embodiment, for obtaining the return force having the nonlinear characteristic in the entire range from the initial position to the lower limit position, the buffer member 34 may be fixed to the limit plate 23. Further, the coil spring 33 may be constructed so as to be fixed to the limit plate 23 via the buffer member 34, without being fixed to the underside of the ceiling part of the rear portion of the cover 12. In such a configuration, the characteristic of the return force with respect to the change of the pivot angle of the foot board 20 can be made similar to that in the illustrated embodiment of FIG. 1. Further, as in the illustrated embodiment of FIG. 1, the upper end 16*a* of the coil spring 16 may be fixed to the foot board 20.

FIG. 4C shows a pedal device according to the third modified embodiment. The pedal device of FIG. 4C is constructed such that a leaf spring 35 is disposed in place of the coil spring 16 in the pedal device of FIG. 4B. Illustration of the coil spring 33, the buffer member 34, the limit plate 23, etc., is omitted. In the pedal device of FIG. 4C, a support base 36 is fixed onto the base portion 11. One end of the leaf spring 35 is supported at a first pivot point P1 of the support base 36, as if the leaf spring 35 acts like a cantilever, and a free end of the leaf spring 35 is in pressing contact with the lower surface of the foot board 20 so as to be slidable thereon. A portion of the upper surface of the support base 36 from the first pivot point P1 to a second pivot point P2 which is located forward of the first pivot point P provides a flat surface, and a portion of the upper surface of the support base 36 which is located frontward of the second pivot point P2 provides a curved surface that is convex upward.

In the thus constructed pedal device, when the foot board 20 is in the nonoperated state and in the free state, the foot board 20 slightly flexes the leaf spring 35 by its self weight, and the pedal device is kept in the equilibrium state shown in FIG. 4B in which the foot bard 20 is indicated by the solid line. In the equilibrium state, the free end of the leaf spring 35 is in contact with the lower surface of the foot board 20, and the limit plate 23 is in contact with the buffer member 34. In the pivot area from the initial position to the lower limit position, the limit plate 23 is located away from the buffer member 34 except for an area that is very close to the initial position. Accordingly, the leaf spring 35 is flexed about the first pivot point P1, thereby giving a force to the foot board 20, and the coil spring 33 does not give a force to the foot board 20. From a time point when the leaf spring 35 comes into contact with the second pivot point P2 in the midst of the pivotal movement of the foot board 20, the leaf spring 35 begins to be flexed such that the most forward contact position on the portion of the upper surface of the support base 36 located frontward of the second pivot point P2 is gradually shifted frontward. In this instance, the leaf spring 35 functions as a leaf spring having a smaller length than in its initial state, so that the leaf spring 35 has a higher spring constant. Therefore, as in the illustrated embodiment of FIG. 1, the degree of increase of the return force with respect to an increase in the depression direction becomes higher from the intermediate position between the initial position and the lower limit position in the midst of the depression stroke. In other words, the foot board 20 is given the return force having a nonlinear characteristic with respect to the change of the pivot angle of the foot board 20.

On the other hand, in the pivot area from the initial position to the upper limit position, the leaf spring 35 is located away from the foot board 20 except for an area that is very close to the initial position. Accordingly, as in the second modified embodiment, the return force in the depression direction having a linear characteristic is given to the foot board 20.

In the third modified embodiment, the leaf spring 35 may be disposed such that its free end is always held in pressing contact with the lower surface of the foot board 20. In the third modified embodiment, the portion of the upper surface of the support base 36 from the first pivot point P1 to the second pivot point P2 may be formed as a curved surface which is convex upward, and the most forward contact position on the portion of the upper surface of the support base 36 may be gradually shifted frontward. In such a configuration, the degree of increase of the return force with respect to the increase of the depression angle gradually becomes hither in the depression stroke As described above, various kinds of elastic member such as springs in various forms may be employable as the elastically holding mechanism, and the elastically holding mechanism is not limited to those illustrated above.

Figure 4D:
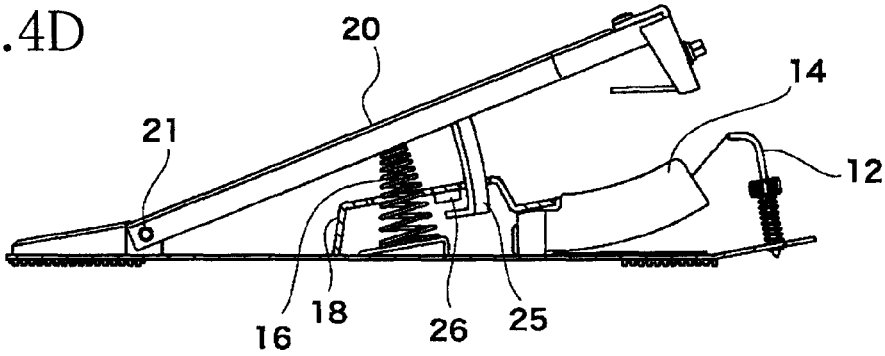

In the illustrated embodiment and the modified embodiments, the structure for defining the upper limit position of the foot board 20 in the counter-depression direction, as an upper-limit-position defining mechanism, is not limited to the limit plate 23 and the stopper portion 13. For instance, as the upper-limit-position defining mechanism, there may be employed a structure according to a fourth modified embodiment shown in FIG. 4D. In the fourth modified embodiment, an engaging member 25 is provided so as to be suspended from the foot board 20. The engaging member 25 has an L shape in side view. The engaging member 25 passes through the hole of the spring cover portion 18, and its lower end extends frontward so as to have a hook-like portion. A stopper portion 26 is fixed to the inside of the spring cover portion 18. When the hook-like portion of the engaging member 25 that extends frontward at the lower end of the engaging member 25 comes into contact with the stopper portion 26, the upper limit position of the foot board 20 in the counter-depression direction is defined.

The position at which the engaging member 25 is disposed is intermediate in the front-rear direction of the foot board 20. At the position, the pivot amount of the engaging member 25 is smaller as compared with the pivot amount of the limit plate 23. Therefore, the size of the cover 12 can be reduced. The engaging member 25 and the stopper portion 26 may be disposed at a position closer to the pivot shaft 21.

While the embodiment and the modified embodiments of the present invention have been described in detail by reference to the accompanying drawings, it is to be understood that the present invention may be embodied with various other changes and modifications, which may occur to those skilled in the art, without departing from the spirit and scope of the invention defined in the appended claims.

The invention claimed is:

1. A pedal device for an electronic percussion instrument, the pedal device comprising:

a base placed on a floor surface;

a foot board pivotably supported at one end portion thereof with respect to the base and configured to pivot in a pivotable range between a lower limit position in a depression direction and an upper limit position in a direction opposite to the depression direction; and an elastically holding mechanism configured to elastically support the foot board in an equilibrium state at an initial position within the pivotable range in a non-operated state in which the foot board is not operated, a cover member extending upwardly from one end portion of the base and having a ceiling portion;

a stopper formed of a buffer member disposed on an underside of the ceiling portion;

a limit plate extending from an opposite end portion of the foot board that is opposite from the one end portion where the foot board is pivotably supported and extending downwardly from the foot board and includes an abutting surface configured to abut the stopper, wherein the limit plate, including the abutting surface, does not contact the stopper at a standstill state of the foot board where the foot board is not operated, and wherein the opposite end portion of the foot board is disposed above the ceiling portion while the abutting surface is disposed below the ceiling portion when the abutting surface abuts the stopper.

2. The pedal device according to claim 1, wherein:

when the foot board is located between the initial position and the upper limit position, the elastically holding mechanism is configured to provide a first return force, as a tension force, having a substantially linear characteristic with respect to a change of a pivot angle of the foot board, the first return force returning the foot board to the initial position, wherein when the foot board is located between the initial position and the lower limit position or when the foot board is located between an intermediate position, which is between the initial position and the lower limit position, and the lower limit position, the elastically holding mechanism is configured to provide a second return force, as a compression force, having a nonlinear characteristic with respect to the change of the pivot angle of the foot board, and the first return force causes the foot board to rotate in a direction toward the lower limit position while the second return force causes the foot board to rotate toward the upper limit position.

3. The pedal device according to claim 2, wherein the elastically holding mechanism is a single spring.

4. The pedal device according to claim 2, wherein a degree of a change of the first return force with respect to the change of the pivot angle of the foot board when the foot board is located between the initial position and the upper limit position is smaller than a degree of a change of the second return force with respect to the change of the pivot angle of the foot board when the foot board is located between the intermediate position and the lower limit position.

5. The pedal device according to claim 2, wherein a degree of a change of the second return force with respect to the change of the pivot angle of the foot board when the foot board is located between the intermediate position and the lower limit position is larger than a degree of a change of the second return force with respect to the change of the pivot angle of the foot board when the foot board is located between the initial position and the intermediate position.

6. The pedal device according to claim 5, wherein the degree of the change of the second return force with respect to the change of the pivot angle of the foot board when the foot board is located between the intermediate position and the lower limit position gradually increases as the foot board gets closer to the lower limit position.

7. The pedal device according to claim 5, wherein:

the degree of the change of the second return force with respect to the change of the pivot angle of the foot board when the foot board is located between the intermediate position and the lower limit position is non-constant, and the degree of the change of the second return force with respect to the change of the pivot angle of the foot board when the foot board is located between the initial position and the intermediate position is constant.

8. The pedal device according to claim 3, wherein:

the single spring is disposed between the base and the foot board, and a spring constant of a portion of the single spring, which portion actually exerts a force on the foot board, is larger when the foot board is located between the intermediate position and the lower limit position than when the foot board is located between the initial position and the intermediate position.

9. The pedal device according to claim 8, wherein a spring constant of the single spring gradually increases as the foot board gets closer to the lower limit position when the foot board is located between the intermediate position and the lower limit position.

10. The pedal device according to claim 8, wherein a spring constant of the single spring is constant when the foot board is located between the intermediate position and the lower limit position.

11. The pedal device according to claim 8, wherein the single spring is a coil spring having a diameter that increases toward one end portion thereof nearer to the base.

12. The pedal device according to claim 11, wherein the coil spring has a lower end fixed to the base and an upper end fixed to the foot board.

13. The pedal device according to claim 8, wherein the each of the first and second return forces is a net force difference between a gravitational force that urges the foot board to rotate in a direction toward the lower limit position and the single spring urging the foot board to rotate in a direction toward the upper limit position.

14. The pedal device according to claim 2, wherein the elastically holding mechanism is a plurality of springs.

15. The pedal device according to claim 2, wherein a degree of change of the first return force with respect to the change of the pivot angle of the foot board is less than a degree of a change of the second return force with respect to the change of the pivot angle of the foot board.

* * * * *